United States Patent [19]

Johne et al.

[11] 4,408,529

[45] Oct. 11, 1983

[54] PLATE CLAMPING DEVICE

[75] Inventors: Hans Johne, Radebeul; Arndt Jentzsch, Coswig; Günter Schumann, Radebeul; Arnfried Jehring, Coswig; Fritz Liebschner, Weinböhla, all of German Democratic Rep.

[73] Assignee: Veb Kombinat Polygraph "Werner Lamberz" Leipzig, Leipzig, German Democratic Rep.

[21] Appl. No.: 201,321

[22] Filed: Oct. 27, 1980

[30] Foreign Application Priority Data

Oct. 29, 1979 [DD] German Democratic Rep. ... 216506

[51] Int. Cl.[3] ..... B41F 15/04

[52] U.S. Cl. ..... 101/415.1

[58] Field of Search ..... 101/415.1; 51/364, 365, 51/366, 367, 368, 369

[56] References Cited

U.S. PATENT DOCUMENTS

| | | | |
|---|---|---|---|
| 1,286,684 | 12/1918 | McCracken | 101/415.1 |
| 1,374,859 | 4/1921 | Marquardt | 101/415.1 |
| 2,837,025 | 6/1958 | Pechy | 101/415.1 |
| 3,156,184 | 11/1964 | Shank | 101/415.1 |

FOREIGN PATENT DOCUMENTS

| | | | |
|---|---|---|---|
| 1184855 | 3/1970 | United Kingdom | 101/415.1 |

*Primary Examiner*—Edgar S. Burr
*Assistant Examiner*—Charles A. Pearson
*Attorney, Agent, or Firm*—Michael J. Striker

[57] ABSTRACT

A plate clamping device for clamping flexible printing plates in rotary printing machines includes an upper guiding rail and a lower guiding rail to receive and clamp a printing plate therebetween. The device is provided with two spaced from one another bolts and a clamping arrangement centrally positioned between said bolts. The clamping arrangement includes an eccentric stud extending normally to the elongation of the lower rail and a wedged key mounted between the upper rail and the stud. The stud has a surface having a flat portion, a transition curved portion and a cylindrical portion. The wedged key is arranged in engagement with this surface and upon rotation of the stud the key may rest on the flat portion of the stud when the device is in a plate-releasing position or the key may engage with the cylindrical portion of the stud whereby the key is self-arrested and the rails clamp a printing plate.

4 Claims, 2 Drawing Figures

PLATE CLAMPING DEVICE

BACKGROUND OF THE INVENTION

The present invention relates to rotary printing machines and more particularly to plate clamping devices for clamping flexible printing plates on printing rollers of rotary printing machines.

The clamping devices for clamping printing plates are normally known in the art. These devices include a rigidly mounted lower guiding rail and an upper guiding rail which are merely connected to each other by means of bolts having rounded heads in such a fashion that the upper rail may pivot relatively to the lower rail. These devices include an eccentric shaft extended over the entire length of the upper rail and positioned between the upper and lower rails and operated by a plug spanner. The clamping action between the upper rail and the lower rail after a printed plate has been inserted therebetween is attained by rotation of the eccentrical shaft which generates the pivoting movement of the upper rail between its open position and closed positions. The opening movement of the clamping device is effected by means of compression springs mounted between the upper and lower guiding rails. This is disclosed in the U.S. Pat. No. 3,156,184.

The disadvantage of this otherwise satisfactory device is that because of different distribution of the clamping force over the entire length of the clamping device the unavoidable deviation from parallelism between the premanufactured upper and lower guiding rails occurs in prior art device. Even by adjustment of the lower and upper guiding rails parallel to one another the parallelism between the eccentrical shaft and the clamping force application surface of the upper rail cannot be obtained.

Because the clamping force usually results in elastic deformation even substantially small mass deflections become effective.

A further disadvantage of the prior art devices resides in that the clamping force is always increased in the vicinity with bolts mounted between the upper and lower guiding rails. This is particularly disadvantageous since the ends of the printing plates must be sufficiently rigidly clamped to each other to avoid slippage of wrongly guided printing plates to be inserted into the clamping device.

It has been also found disadvantageous that not all the thickness of the printing plate takes the parallel position when the plate is inserted between the upper and lower rails which leads to higher local loads exerted on the printing plate by clamping action and therefore rupture or displacement of the printing plate into a clamping gap may occur which makes impossible reuse of the equipment with the truing systems.

Still another disadvantage of the conventional devices is that even not great wear which may occur in bolts with rounded heads sufficiently decreases the clamping force. The operation of the eccentric shaft by a plug spanner is unpractical and requires enough space to install the same on the clamping device.

SUMMARY OF THE INVENTION

It is an object of the invention to provide an improved plate clamping device which avoids by simple means the aforementioned disadvantages encountered in the prior art.

Another object of the invention is to provide an improved plate clamping device which is reliable in operation and easy in assembling.

Still another object of the invention is to provide a plate clamping device which provides a substantially increased clamping force acting at the ends of the clamping arrangement and uniform over the entire length of the clamping device.

Yet another object of the invention is to provide an improved plate clamping device which independently compensates for a decreasing of clamping force due to wear of the components of the clamping device.

Still another object of the invention is to provide a clamping device suitable for printing plates having differing thickness.

Yet another object of the invention is to provide an improved plate clamping device with sufficient accessibility to the clamping components during operation.

These and other objects of the invention are attained by a plate clamping device for clamping flexible printing plates on printing rollers in rotary printing machines, comprising a lower guiding rail and an upper guiding rail adapted to clamp a portion of a printing plate therebetween; at least two links connecting said rails with freedom of relative movement between a plate-clamping position and a plate-releasing position; biasing means permanently biasing said rails to said plate-releasing position; and clamping means operative for applying to one of said rails midway between said links a clamping force which moves said one rail to said plate-clamping position.

The links are spaced from one another and said clamping means may be located in the central region between said links and below said upper guiding rail.

Each of said links may be a bolt with a rounded head. These rounded heads may be positioned in the upper guiding rail whereby said upper guiding rail is adapted to pivot about said rounded heads when it is moved toward said plate-releasing position.

The clamping means may include a rotatable clamping stud mounted in the lower guiding rail and extending normally to a direction of elongation of said lower guiding rail and a movable key arranged between said upper guiding rail and said stud.

The clamping stud may include a wrench part outwardly extended from said lower guiding rail and a substantially cylindrical part extending through the lower guiding rail, said wrench part being eccentrical relative to said cylindrical part.

The cylindrical part may be formed with a surface including a substantially flat portion, a transition curved portion and an arresting portion, said portions merging one into another in a circumferential direction.

The key may be formed with a tapering lower surface adapted to engage with said surface of said cylindrical part of said stud, whereby said key may be self-clamped when the stud is rotated to position said arresting portion against said tapering lower surface.

The key may also be provided with a pressing upper surface which is rounded.

The upper surface of said key may be so dimensioned that between said upper surface and the upper guiding rail a clearance is provided when said lower tapering surface of the key is positioned against the flat portion of the stud.

The lower surface is converging in the direction toward said plate-clamping position.

The lower tapering surface of the key may form a thicker side and a thiner side of the key and the device may be provided with an adjusting element facing said, thicker side of the key.

The key may be biased by a supporting spring, said spring engaging with said thinner side of said key.

The adjusting element may include an eccentrical projection.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
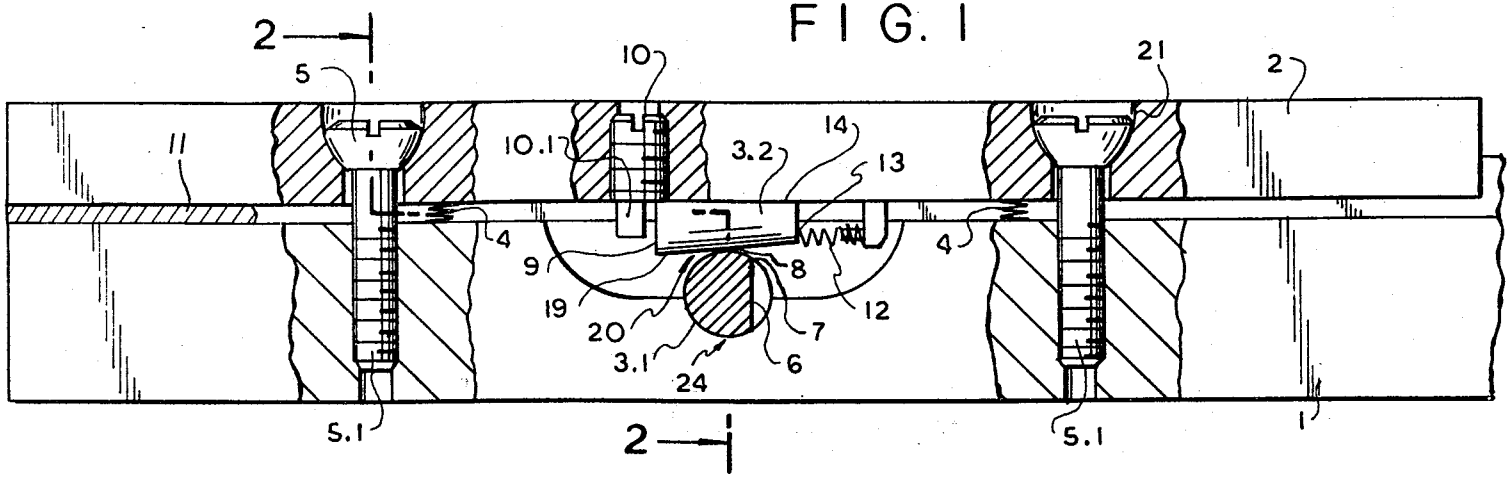
FIG. 1 is a side view, partially in section, of a plate clamping device in a clamping position.

Referring to the drawings, and first to FIG. 1, a plate clamping device of the invention comprises a lower guiding rail 1 and an upper guiding rail 2 which may be open or closed relative to each other to receive and further clamp therebetween or release a printing plate denoted as 11. A pair of prestressed compression springs 4 are arranged between the upper guiding rail 2 and the lower guiding rail 1 which urge the upper rail in the upward direction towards a plate-releasing position which is clearly shown in FIG. 2. Two bolts 5 having rounded heads and threaded elongated portions 5.1 are inserted between the guiding rails to interconnect them one to another. The rounded heads of the bolts 5 are positioned in the respective recesses 21 formed in the upper rail 2 whereas the elongated portions of the bolts are arranged with a gap in the upper rail 2. Such a structure permits the upper rail 2 to pivot about the bolts 5 when the guiding rail 2 tends towards a plate-releasing position. A clamping arrangement generally denoted as 20 is located in the central region between the bolts 5. The clamping arrangement is composed of a clamping stud 3.1 mounted in the guiding rail 1 and extending in a direction normal to elongation of the lower rail 1 and a wedged key denoted as 3.2. The stud 3.1. includes a wrench portion 22 outwardly extended from the rail 1 and an inner substantially cylindrical portion 23. The portion 23 in the vicinity with the hex head portion 22 is formed with a surface 24 having a relatively flat portion 6 merging into a transition curved portion 7 which in turn merges into a cylindrical arresting portion 8. This surface is arranged in engagement with a tapering surface 19 formed on the lower side of the key 3.2.

Figure 2:
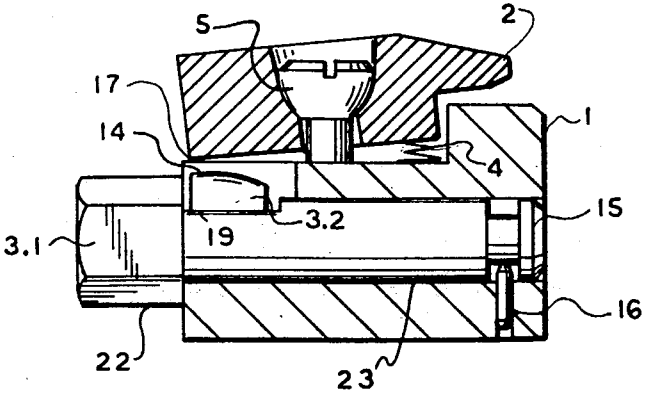
FIG. 2 is a sectional view taken along line II—II of FIG. 1 illustrating a plate clamping device in a released position.

The hex head portion 22 is positioned eccentrically to the inner cylindrical portion 23. The lower tapering surface 19 constitutes on the key 3.2 a relatively thicker side 9 and a relatively thinner side 13. The axial movement of the key 3.2 in a leftward direction is limited by an adjusting member 10 mounted in the upper guiding rail 2 and provided with a downwardly extending eccentrical projection 10.1. The adjusting member 10 serves for adjusting printing plates of differing thickness so that each plate may be easily adjusted and clamped parallel between two guiding rails. A supporting spring 12 connected to the upper rail 2 engages the thinner side 13 of the key 3.2 to urge the same into engagement with the surface 24. The upper surface 14 of the key 3.2 is rounded as clearly seen in FIG. 2. The angle of tapering of the surface 19 of the key 3.2 may be so selected that the self-arresting position of the key 3.2 when the latter is in engagement with the stud 3.1 may be easily attained. The FIG. 2 illustrates the plate clamping device in the plate-releasing position. The stud 3.1 is extended through a bore 15 formed in the lower rail 1 and is secured therein in the axial direction by means of a radially projecting pin 16. The key 3.2 is located between the eccentric stud 3.1 and the upper guiding rail 2. In the plate-releasing position, the key 3.2 rests on the flat portion 6 of the stud. In this position, a relatively small gap 17 is available between the spherical upper surface of the key and the lower surface of the guiding rail 2. Because the spring 12 urges the key 3.2 toward the adjusting member 10 the initial position of clamping may be defined.

As was mentioned above the compression springs 4 connected to the lower guiding rail 1 urge the upper rail 2 toward the open or plate-releasing position. After a printing plate has been inserted between the rails 1 and 2 the eccentric stud 3.1 is rotated in order to clamp the printing plate. As the stud is rotated the transition curved portion 7 engages with the lower surface 19 of the key 3.2 and, upon further rotation of the stud, the cylindrical arresting portion 8 of the stud abuts against the key 3.2. In this position clamping is finished and the key 3.2 is self-arrested.

The central location of the clamping device permits the application of a clamping force centrally between the bolts 5 whereby the greatest clamping force is applied at the ends of the printing plate through elastic deformation whereas relatively uniform distribution of clamping force along the length of the printing plate is attained. The clamping device of the invention also provides independent compensation of wear gaps which may occur between the device components so that the losses of clamping forces are excluded in the clamping device. By rotating of the eccentric stud 3.1 the counter force is exerted between the stud and the upper guiding rail 2 in the direction of locking movement. The further advantage of the clamping device is that the position of the clamping stud therein is most favorable.

It will be understood that each of the elements described above, or two or more together, may also find a useful application in other types of a plate clamping device differing from the types described above.

While the invention has been illustrated and described as embodied in a plate clamping device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A plate clamping device for clamping flexible printing plates on printing rollers in rotary printing machines, comprising a lower guiding rail and an upper guiding rail adapted to clamp a portion of a printing plate therebetween; at least two bolts spaced from one another and connecting said rails with freedom of relative movement between a plate-clamping position and a plate-releasing position, each of said bolts having a rounded head positioned in said upper guiding rail, whereby said upper guiding rail is adapted to pivot about said rounded heads when it is moved toward said plate-releasing position; biasing means permanently biasing said rails to said plate-releasing position; and clamping means located in the central region between said bolts and below said upper guiding rail and operative for applying to one of said rails midway between said bolts a clamping force which moves said one rail to said plate-clamping position, said clamping means including a rotatable clamping stud mounted in said lower guiding rail and extending normally to a direction of elongation of said lower guiding rail, a movable key arranged between said upper guiding rail and said stud, and an adjusting element for limiting the movement of said key, said clamping stud including a hex head part outwardly extended from said lower guiding rail and a substantially cylindrical part extending through said lower guiding rail, said head part being eccentrical relative to said cylindrical part, said cylindrical part being formed with a surface including a substantially flat portion, a transition curved portion and an arresting portion, said portions merging one into another in a circumferential direction, said key being biased by a supporting spring and having a rounded upper surface and a tapering lower surface adapted to engage with said surface of the cylindrical part so that said key becomes clamped between the stud and the upper rail when said stud is rotated to position said arresting portion against said tapering lower surface or released when said stud is rotated to position said flat portion against said tapering lower surface, the upper surface of said key being so dimensioned that between said upper surface and said upper guiding rail a clearance is provided when said lower tapering surface of said key is positioned against said flat portion of said stud, said lower surface being inclined in the direction toward said upper guiding rail.

2. The device of claim 1, wherein said lower tapering surface forms a thicker side and a thinner side of said key, said adjusting element facing said thicker side of said key.

3. The device of claim 2, said supporting spring engaging with said thinner side of said key.

4. The device of claim 3, wherein said adjusting element includes an eccentrical projection.

* * * * *